US007151236B2

(12) United States Patent
Ducruet et al.

(10) Patent No.: US 7,151,236 B2
(45) Date of Patent: Dec. 19, 2006

(54) PUSH-BUTTON ELECTRICAL SWITCH WITH DEFORMABLE ACTUATION AND METHOD FOR MAKING SAME

(75) Inventors: René Ducruet, Cranves-Sales (FR); Laurent Mounier, Annemasse (FR)

(73) Assignee: Dav Societe Anonyme, Creteil (FR)

( * ) Notice: Subject to any disclaimer, the term of this patent is extended or adjusted under 35 U.S.C. 154(b) by 0 days.

(21) Appl. No.: 10/531,216

(22) PCT Filed: Sep. 29, 2003

(86) PCT No.: PCT/FR03/02856

§ 371 (c)(1),
(2), (4) Date: Apr. 14, 2005

(87) PCT Pub. No.: WO2004/036609

PCT Pub. Date: Apr. 29, 2004

(65) Prior Publication Data

US 2005/0259382 A1 Nov. 24, 2005

(30) Foreign Application Priority Data

Oct. 16, 2002 (FR) ..... 02 12882

(51) Int. Cl.
*H01H 5/30* (2006.01)
*H01H 11/00* (2006.01)

(52) U.S. Cl. ..... 200/406; 200/516; 29/622

(58) Field of Classification Search ..... 29/622; 200/406, 516, 517, 520, 292
See application file for complete search history.

(56) References Cited

U.S. PATENT DOCUMENTS

| | | | | | |
|---|---|---|---|---|---|
| 4,057,520 | A | * | 11/1977 | Schwartz | 200/16 D |
| 4,400,596 | A | * | 8/1983 | Fukukura et al. | 200/5 A |
| 4,705,925 | A | * | 11/1987 | Vermeulen | 200/520 |
| 4,755,645 | A | * | 7/1988 | Naoki et al. | 200/276.1 |
| 4,778,952 | A | * | 10/1988 | Watkins et al. | 200/5 A |
| 4,913,285 | A | * | 4/1990 | Tsutsumi et al. | 200/306 |
| 5,199,557 | A | * | 4/1993 | Brandt et al. | 200/406 |
| 5,245,147 | A | | 9/1993 | Kobayashi | |
| 6,073,341 | A | * | 6/2000 | Odorfer | 29/623 |
| 6,634,090 | B1 | * | 10/2003 | Koyama et al. | 29/622 |
| 6,906,275 | B1 | * | 6/2005 | Koyama et al. | 200/516 |
| 2002/0056627 | A1 | | 5/2002 | Bouvier et al. | |

FOREIGN PATENT DOCUMENTS

FR 2 800 904 A1 5/2001

* cited by examiner

*Primary Examiner*—Michael A. Friedhofer
(74) *Attorney, Agent, or Firm*—Osha Liang LLP

(57) ABSTRACT

A switching device intended for assembly on an electric printed circuit mounting plate includes contacts to be electrically connected when a switching operation is performed. The switching device includes a switch component associated with an actuator, which allows for an electrical connection to be established between said contacts when it is deflected under pressure transmitted by the actuator. The switching device also includes a base plate equipped with holding means for holding the switch component prior to the assembly of the switching device on the mounting plate, the switch component being disengaged from the holding means when the device is assembled on the mounting plate.

25 Claims, 5 Drawing Sheets

PUSH-BUTTON ELECTRICAL SWITCH WITH DEFORMABLE ACTUATION AND METHOD FOR MAKING SAME

BACKGROUND OF THE INVENTION

1. Field of the Invention

The present invention relates to a pressure activated electric switch of the so-called "blister" type, in other words where switching is carried out by the deflection, under the effect of an actuator, of a conductive resilient blister dome against two conductors to be connected. More particularly, the invention proposes in this context on the one hand an optimised design and assembly of the parts constituting the switch, making it possible to improve the touch response thereof, and on the other hand a judicious process for manufacturing and packaging both said parts and the assembled switch.

A typical application of the invention is the low voltage switching used in respect of ancillary controls in a motorcar passenger compartment (window winders, seat positioning, sunroof, car radio, on-board computer, unit controls, etc) where the switch is mounted directly onto an electric circuit mounting plate, for example a printed circuit.

2. Description of Related Art

A known example of a blister switch that is particularly advantageous in terms of ergonomics, reliability, and easy installation by automated tools is described in French patent application FR-A-2 800 904 filed in the name of the DAV S.A. company. This blister switch 1, shown in FIGS. 1 to 3, includes a flexible and distortable actuator 2 which covers a switch component in the form of a resilient metal dome forming a blister 4, the latter being positioned just above a switching zone 6 at which are located two terminal points 8 and 10 of respective tracks 12 and 14 of a printed circuit 16. These terminal points may thus be connected electrically via the blister 4 when it is inflected towards the surface of the printed circuit under the action of pressure transmitted by the actuator 2.

The actuator 2 comprises a base 2*a* at an upper part 2*b* terminating in an actuation nipple 18 accessible by the user, on which the force required to distort the blister 4 is exerted.

More particularly, the blister 4 is housed in the space 20 (FIG. 2) defined between the upper surface of the printed circuit 16 and a curved internal surface 22 of the actuator 2. The blister 4 rests on the printed surface at several outward curving peripheral support points 24, by which it is kept in a raised position.

The blister has a central incoming part 26 plumb with one 8 of the terminal points, with which it creates the contact, the other terminal point 10 being in permanent contact with the blister in proximity to one of the peripheral support points 24. The base of the actuator is annular and its periphery constitutes a sealing lip 28.

This is housed in a groove 30 provided in sealing means constituted by a hoop 32, which is anchored to the printed circuit 16 by anchoring lugs 34. To this end, orifices 36 are provided in the printed circuit so that the lugs 34 can be clipped on to them. In this way, the printed circuit 16 acts as a support for the hoop 32 and, thereby, for the switching device in its entirety 1. The hoop 32 is made in a material that is rigid relative to that of the actuator 2, and more particularly relative to the sealing lip 28.

As is shown in FIG. 2, the groove 30 is constituted by a clearance comprising a horizontal bearing surface 30*a* and a vertical bearing surface 30*b* so as to constitute support zones for the sealing lip 28 and so to improve the seal and the insulation relative to the outside of the switching zone 6. In the non-actuated state, the sealing lip is applied strongly at least to the horizontal bearing surface 30*a*, which prevents any matter from being introduced into the space 20.

A more comprehensive description of this switch is given in the aforementioned patent document FR-A-2 800 904.

Before assembling the switch on the printed circuit 16, it is necessary to hold the blister 4 in its normal position relative to the actuator 2. To this end, the curved internal surface 22 of the actuator is provided with four pairs of segments or lips 38, as shown in FIG. 3, each pair sandwiching a peripheral edge of the blister 4.

These holding means act permanently on the blister, holding it also when the switch is finally assembled on the printed circuit. In fact, these means are only of use when handling prior to and during the installation of the switch, since the blister is then held correctly by the printed circuit 16, and have the secondary effect of disturbing the touch effect of the blister, and of making the assembly of the switch and the geometry of the actuator 2 more complex.

BRIEF SUMMARY OF THE INVENTION

In the light of what has been said above, the invention provides, according to a first aspect, a switching device intended for assembly on an electric circuit mounting plate comprising contacts to be electrically connected when a switching operation is performed, the device including a switch component associated with an actuator, allowing the electrical connection to be established between these contacts when this component is deflected under pressure transmitted by the actuator, the device being characterised in that it additionally includes a base plate fitted with holding means for holding the switch component prior to the assembly of the device on the mounting plate, the switch component being disengaged from these holding means when the device is assembled on the mounting plate.

In the preferred embodiment, the switch component is supported only by the mounting plate when the device is assembled on it, since the base plate then provides only a guidance function for the switch component.

Preferably, the switch component disengages itself naturally from the holding means under the effect of a push exerted on the switch component by the mounting plate when the device is assembled on it.

The switch component may be assembled floating relative to the base plate between an initial position in which the switch component is stopped against the holding means and a second position in which it is disengaged from the holding means, this second position being adopted automatically by the installation of the device on the mounting plate.

The switch component may include at least one appendage the free end of which forms a hook, the holding means having a stop for the hook that prevents the switch component from being withdrawn via the surface of the base plate turned towards the mounting plate.

This appendage is preferably a resilient segment starting from one corner of the switch component and the end of which is supported against an internal bearing surface of the base plate, allowing the switch component to be guided relative to the base plate.

The base plate may form a frame around the switch component, since the peripheral wall of the frame has a contact edge intended for support against the mounting plate when the device is assembled on it.

This contact edge may constitute a seal protecting the internal part, in other words the part in which the switch zone is located.

The peripheral wall may have an edge, opposite the contact edge, intended to receive a base portion of the actuator.

To advantage, the actuator is a revolution part.

The device may additionally include a connection part intended on the one hand to hold the actuator on the base plate and on the other hand to ensure the assembly of the device on the mounting plate.

Preferably, this connection part anchors the device to the mounting plate via gripping means that anchor the device to the mounting plate without welding.

In the embodiment, the gripping means form snap-on means intended to pass through at least one hole in the mounting plate and to be anchored against its surface opposite that on which the device is assembled.

The connection part may hold a base portion of the actuator in a sandwich against the base plate.

This connection part may include at least one pin the end of which forms a means for anchoring to the mounting plate, and one part of which incorporates fastening means intended to engage with fastening means related to the base plate.

The base plate may be made in a single piece of flexible plastic material or elastomer.

To advantage, the switch component is a conductive component. Preferably the switch component is presented in the form of a dome, notably a blister dome, made of metal or including metallization allowing the electrical connection to be provided.

According to a second aspect, the invention relates to a process for manufacturing the device according to the first aspect, characterised in that at least one of the parts, and to advantage each of the parts, among the group including:

the connection component, the switch component, and the base plate, is manufactured on a bearing strip, and the part is connected to the bearing strip during assembly of the device, the bearing strip acting also as a means for packaging the part between its manufacture and the assembly of the device.

To advantage, the strip bearing one of the parts of the group is used additionally for packaging the device once it is assembled.

The bearing strip being used to package the assembled device is preferably used to supply a tool for assembling the device on its mounting plate, this tool being of the strip feed type.

The process may additionally include the steps, applied to the connection part when it is fitted with pins, of:

orientating the flared pins respective to the central axis of the connection part, the flare being in the direction of separation from this axis towards their free end, joining the connection part to the base plate, whether or not it is fitted with the switch component, and connecting the whole by orientating the branches parallel to the central axis, so as to bring their fastening means into the respective housing of the base plate.

The invention and the advantages accruing therefrom will emerge more clearly from reading the following description of preferred embodiments, these being given purely by way of example and non-restrictively with reference to the appended drawings in which:

DETAILED DESCRIPTION

Figure 1:
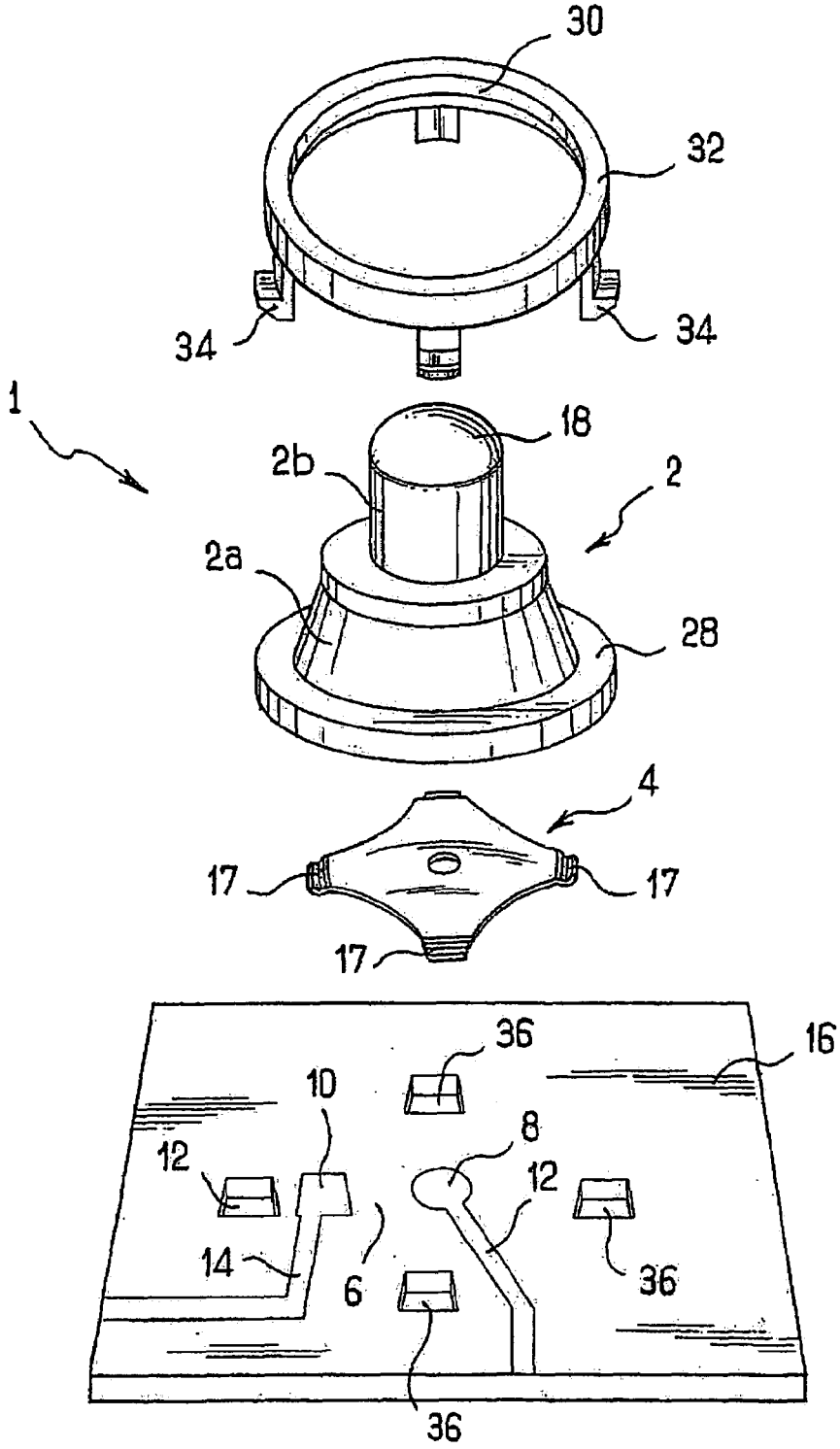
FIG. 1, already described, is an exploded perspective view of the switch and of a printed circuit shown partially and diagrammatically, according to patent document FR-A-2 800 904, FIG. 2, already described, is a cross-section view of the switch in FIG. 1 after assembly on the printed circuit, FIG. 3, already described, is a view from above over the inside of the actuator of the switch in FIG. 1, showing more particularly how the gripping means hold the blister.
Figure 2:
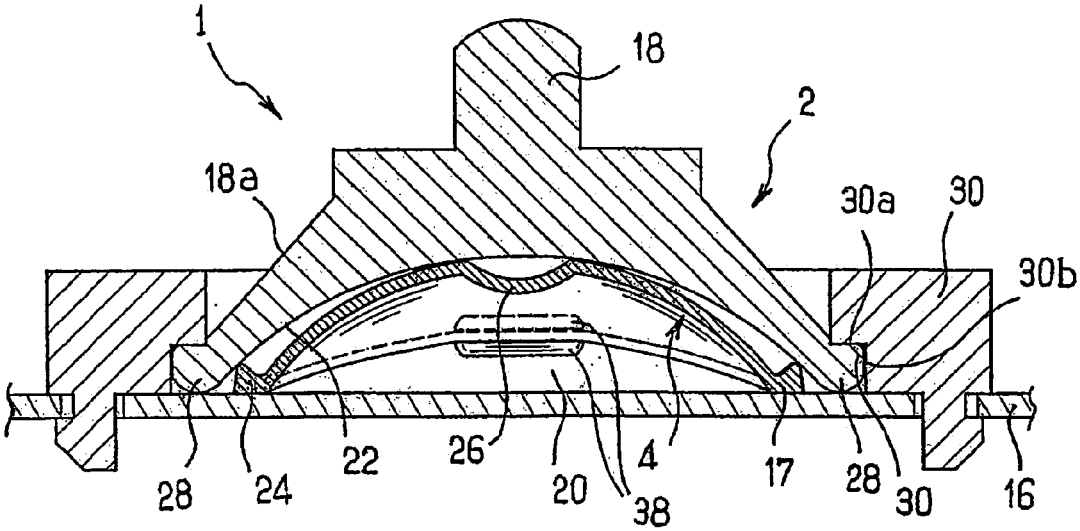
Figure 3:
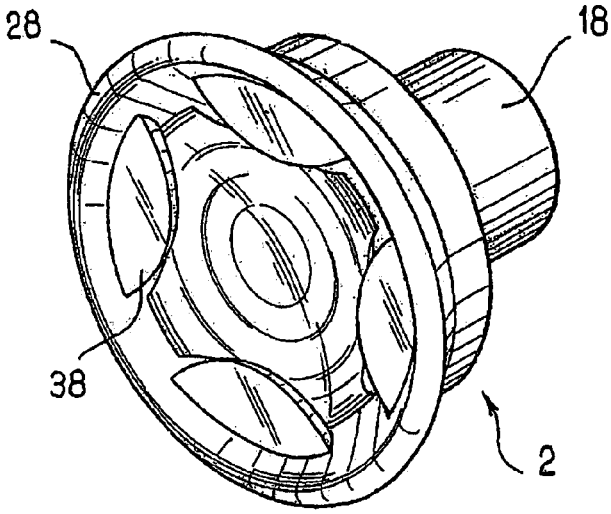

In the following description, the elements that are functionally similar to those in FIGS. 1 to 3 bear the same reference numbers and are considered as already described in the context of these figures; only their possible differences will be indicated in the interests of concision.

Figure 4:
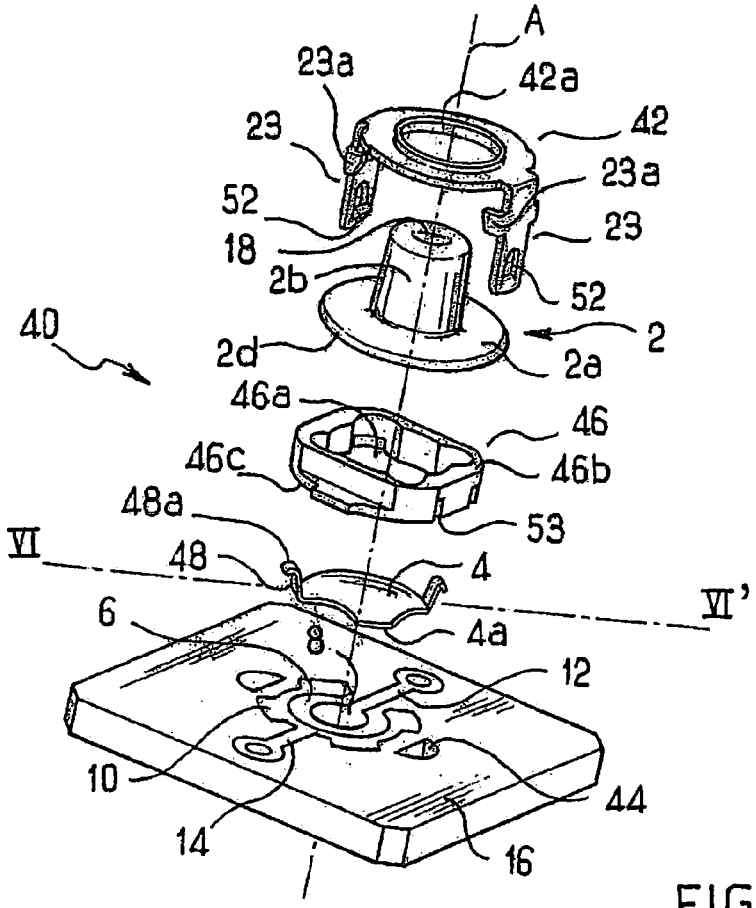
FIG. 4 is an exploded perspective view of a switch and of a printed circuit according to a preferred embodiment of the invention.

As is shown in FIG. 4, the blister switch 40 according to the preferred embodiment of the invention is composed of four parts which are superposed on a central assembly axis A which is perpendicular to the plane of a printed circuit 16 intended to receive it:

a connection component 42 of metal material of a general annular shape, forming a housing which covers the three other components, fitted with two pins 23 allowing the printed circuit 16 to be anchored in respective holes 44, an actuator 2 of a flexible material, for example an elastomer, in the form of a revolution part, including a peripheral base 2*a* and a central up raised part 2*b* which forms a plunger that passes through the central aperture 42*a* of the connection part, a dome-shaped conductive metal blister 4, constituting an example of a switch component providing the electrical connection between two conductive tracks 12, 14 of the printed circuit 16 when the switch is actuated, and a base plate 46 in the form of a spacer which is supported in a sealed way on the printed circuit, equipped with a central aperture 46*a* through which the blister 4 is able to establish a contact with the printed circuit. It additionally used to hold the blister prior to the assembly of the switch on the printed circuit, and to support the base of the actuator 2.

Figure 5:
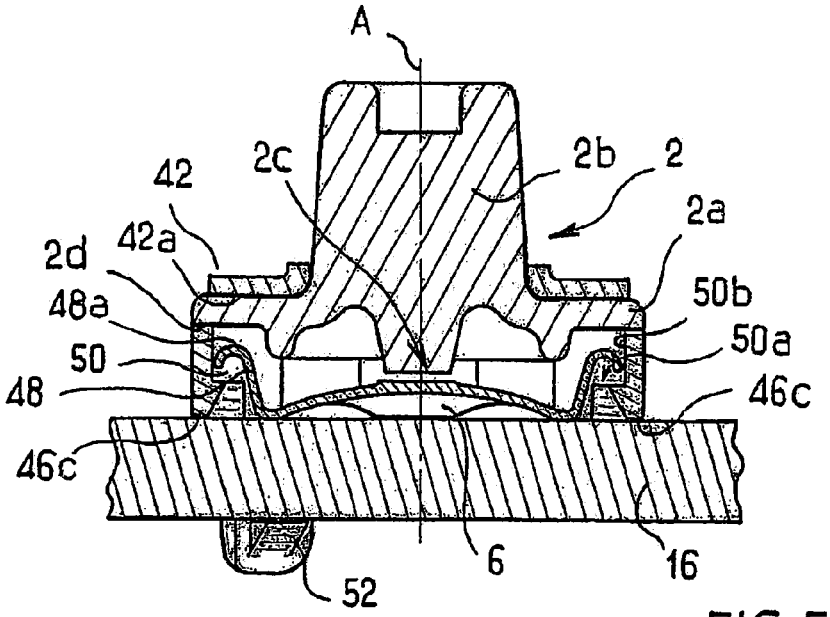
FIG. 5 is a cross-section view of the switch in FIG. 4 after assembly on a printed circuit.

The blister 4 (also designated "blister dome" or "dome") has a main slightly concave surface seen from below (from the printed circuit) with four truncated corners 4*a*, which establish a permanent contact with a terminal zone 10 of one 14 of the conductive tracks. The other track 12 has a contact pad 8 plumb with the top of the concave part of the blister. This top is deflected by elasticity so as to be supported against this contact pad 8 and thus to establish an electrical connection between the two tracks 12 and 14 in response to a push transmitted by the actuator 2 when the user applies pressure to the top 18 thereof. To fulfil this function of transmitting force to the blister, the actuator 2 includes material that fills its entire upper part 2*b* (FIG. 5). This material forms in its lower part a protuberant surface 2*c* of reduced cross-section just above the top of the blister 4, intended to press thereon so as to establish the switch.

The blister 4 comprises two radial lugs 48 starting from two of its diagonally opposite corners 4*a*. Each lug is presented in the form of a resilient segment directed towards the top with a slight inclination, the free edge forming a hook 48*a* intended to be received in a respective housing 50 provided for this purpose in an internal edge of the base plate 46 (FIG. 5).

The actuator 2 is assembled placed on the upper part of the base plate 46, the lower surface 2*d* of the peripheral edge of the base 2*a* being supported against the upper edge 46*b* of the base plate over the whole of its periphery so as to provide the seal at the interface of these two parts.

The pins 23 of the connection component 42 are substantially plane and elongated parallel to the axis of assembly A, starting from diametrically opposite points of the external edge of the connection component towards the printed circuit 16. The plane surfaces of the pins 23 are substantially tangential relative to the upper periphery of the connection component.

These pins 23 have a dual function:

on the one hand to anchor the switch 1 in its entirety to the printed circuit 16, as mentioned above. This function is fulfilled by the free end of each pin, this having a U-shaped tab 52, cut out in the material of the pin and inflected inwards. The tab 52 forms a resilient clip-on (or snap-on) means the end of which is intended to be anchored against a lower surface portion of the printed circuit 16, at the access to one of the holes 44; and on the other hand to anchor the connection component 42 to the base plate 46 and to keep the actuator 2 between these two parts 44 and 46. To this end, the two pins 23 each comprise a pair of claws 23*a*. These start from the respective opposite longitudinal edges of a pin and are turned inwards so as to engage in corresponding respective housings 53 provided in opposite external surfaces of the base plate 46. During the assembly of the switch, the actuator 2 is thus held gripped in a sandwich between the connection component 42 and the base plate 46.

When the four parts, 42, 2, 4 and 46 of the switch 1 are assembled, they are therefore all coupled so as to form an integral whole even prior to assembly on the printed circuit 16. As far as the blister 4 is concerned, the housing 50 of the base plate 46 has in transverse cross-section a lateral bearing surface 50*a*, (parallel to the plane of the printed circuit) and a vertical bearing surface 50*b*. The lateral bearing surface 50*a* constitutes for each hook 48*a* a stop for holding the blister 4, which prevents it from being disunited from the base plate. The vertical bearing surface 50*b* constitutes a stop for the resilient travel of the segment 48 and is used essentially to position, or guide, the blister 4.

Figure 6A:
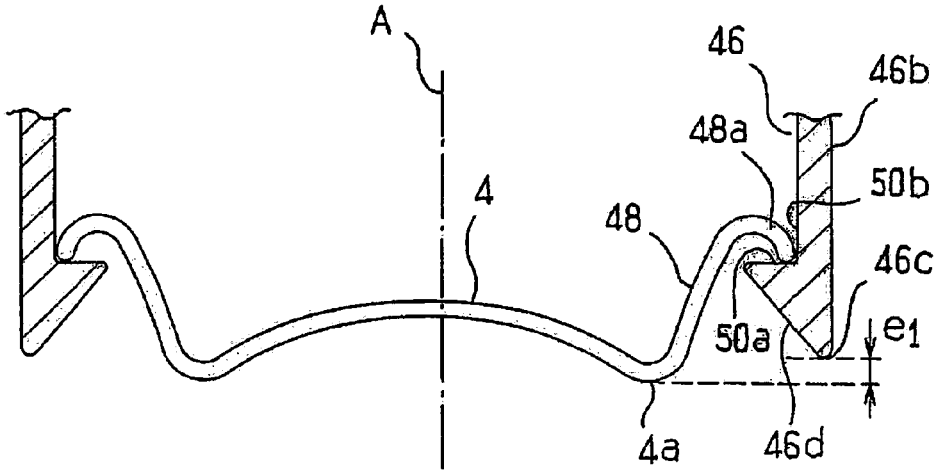
FIG. 6*a* is a partial simplified cross-section view of the switch along the cross-section VI–VI' in FIG. 4, showing the arrangement of the means for holding the blister relative to the base plate prior to assembly on the printed circuit.
Figure 6B:
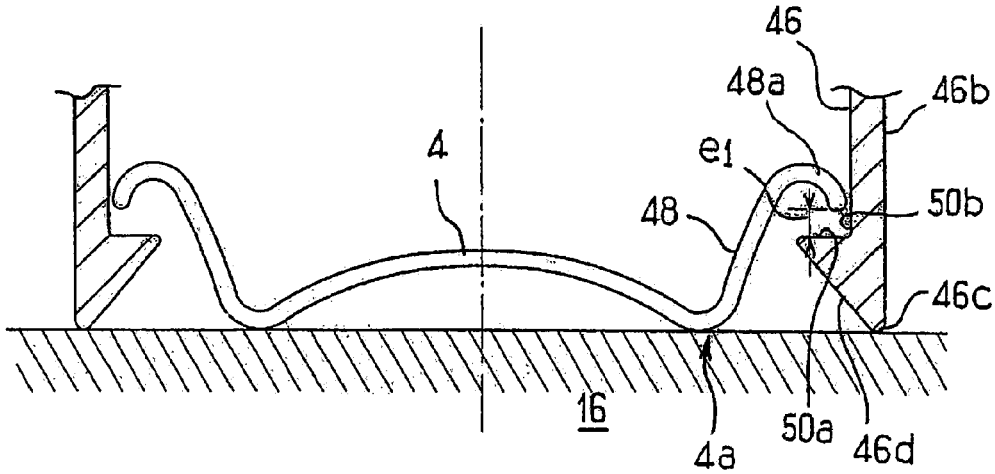
FIG. 6*b* is a partial simplified cross-section view of the switch along the cross-section VI'—VI' in FIG. 4, showing the arrangement of the means for holding the blister relative to the base plate after assembly on the printed circuit.

As is shown in FIG. 6*a* and 6*b*, these two bearing surfaces 50*a* and 50*b* allow a floating assembly of the blister 4, with a clearance el in the direction of the axis of assembly A. This floating assembly allows the blister to be released from its anchoring constituted by the lateral bearing surface 50*a* when the switch is assembled on the printed circuit 16.

More particularly, the start point of each segment 48 at the corner of the blister 4 has a bend 4*a* the external curve of which is turned towards the printed circuit 16. Prior to assembly on the printed circuit 16, this bend constitutes the point of greatest protuberance of the lower surface of the switch 1 when the hook 48*a* is stopped against the lateral bearing surface 50*a* (FIG. 6*a*).

When the switch 1 is assembled on the printed circuit 16, the first physical contact with it is established by the bends 4*a*. These bends then retract towards the base plate, using the clearance el, until the lower edge 46*c* of the base plate comes in its turn to a stop against the surface of the printed circuit in order to adopt the final assembly position, at which the snap on tabs 52 separate so as to be anchored under the printed circuit. As is shown in FIG. 6*b*, the bends 4*a* and the lower edge 46*c* of the base plate are then both on the surface of the printed circuit, and the hooks 48*a* are disengaged from the lateral bearing surface 50*a* by a distance equal to the aforementioned clearance el.

In this assembly position, the blister 4 is released from the anchoring stop 50*a* of the base plate 46, as is shown in FIG. 6*b*, in order to become a self-supported component, supported by the bends 4*a* on the printed circuit. In other words, when the switch 1 is assembled on the printed circuit, neither the base plate 46, nor any other part of the switch, supports the blister 4 in respect of forces in the axis A, in other words those operating during the switch action. It may be noted in this respect that the frictional force between the end of the hooks 48 and the vertical bearing surfaces 50*b* is not to be taken into account, because it is so weak relative to the pressure forces between the printed circuit and the bends 4*a*, particularly when the switch is actuated.

The seal between the inside of the switch, particularly in the switch zone 6, and the outside environment is provided by the contact between the lower edge 46*c* of the base plate and the surface of the printed circuit 16. To this end, this lower edge is made in the form of a peripheral sealing lip 46*c* able to distort when it is placed on the printed circuit 16. This lip 46*c* is of an elastomer or a flexible plastic material, just like the rest of the base plate 46. The thickness of this lip 46*c* reduces gradually via an internal bevelled profiling of the internal surface 46*c* of the base plate (FIGS. 6*a* and 6*b*), until a sensitive contact pad is formed with the printed circuit, allowing it to better conform hermetically to its surface shape. In this embodiment, the seal means 46*c* of the switch 1 are therefore integrated in a single piece with the base plate 46, the latter being able to be made easily in a single piece by flexible plastic or elastomer moulding.

As a variant, the seal of the inside of the switch 1, at the interface with the printed circuit, may be provided by the actuator 2, rather than by the base plate. In this case, the base 2*a* of the actuator 2 may then be dimensioned so as to extend beyond the base plate 46 and completely envelop it, this base being provided with a sealing lip making contact with the printed circuit 16, just like the lip 18 described with reference to FIGS. 1 to 3.

The design of the switch 20 in the form of separate mechanically straightforward parts (casing 42, actuator 2, blister 4 and base plate 46) make it possible furthermore to conceive of particularly rapid and judicious manufacturing and packaging techniques.

Figure 7:
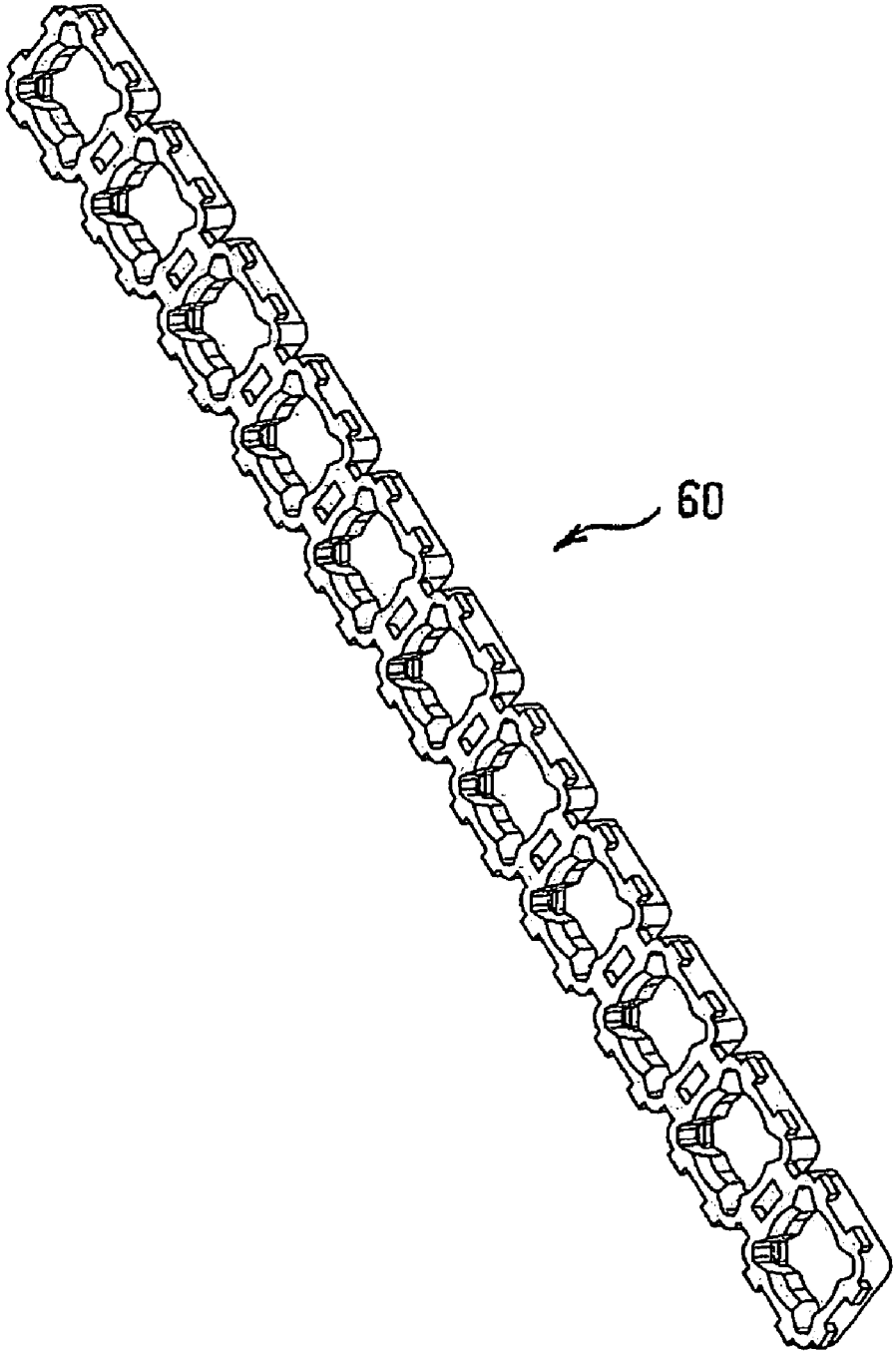
FIG. 7 is a perspective view showing a bearing strip according to an embodiment of the invention.

In this way, the connection component 42, the blister 4 and the base plate 46 may each be made by being stamped (or moulded in respect of the base plate) directly on a respective bearing strip. In one embodiment of the present invention a plurality of parts can be stamped on the bearing strip 60 as shown in FIG. 7. To advantage, the parts are only removed from their bearing strip 60 at the switch assembly site, which allows the bearing strip 60 to be used for packaging the parts. The parts, which may come from different sources of supply, will for example be packaged in their bearing strip 6O in a roll for transportation from the supplier to the assembly site. At this site, the bearing strips may be installed in a strip feed assembly programmable logic controller. Some of the parts, particularly the blister 4, may be coated with a protective film, for example a peelable plastic film, to avoid getting dirty or scratched during handling. This bearing strip packaging allows a more rational industrialisation relative to the conventional technique of separating the parts at their manufacturing source, then transporting them loose to a site for feeding onto vibration trays of a switch assembly line, possibly with packing and unpacking individually or in batches before and after transport. However, this technique can quite obviously be used for manufacturing the present switch.

During the assembly of the switch 1, one of its constituent parts, for example the connection component 42, may remain at least partially anchored to its strip. This arrangement allows this strip to be used to package the assembled switch unit 1. The strip in question may then be transported, for example in the form of a roll, for installation in a strip feed programmable logic controller used to assemble the switch on its printed circuit. As a variant, the strip may be separated into individual switches at the assembly site if another assembly technique is intended. Preferably, a strip of interleafed material is inserted between each wound coil of the strip and/or a peelable film is placed on the blister. It may be noted that it is not strictly necessary for one of the constituent parts of the switch to be kept anchored to its strip during manufacture in respect of the aforementioned packaging, so long as the assembled switches are able to be kept in some way or other on one of the strips.

With regard to anchoring the connection component 42 to the base plate 46 during switch assembly 40, the embodiment provides to advantage for an initial pre-folding of the pins 23 from their original position, which is in the plane of the annular part in the example. This pre-folding, over an angle of about 45°, brings the pins to a flared position relative to the central axis A, in the direction of separation towards the free end. This arrangement makes it possible to bring the base plate 46, whether or not fitted with the metal dome 4, under this connection part 42 and to connect the whole by terminating the folding at 90°, in other words by orientating the pins parallel to the axis A, in order to bring the claws 23*a* into their respective housing 53 in the base plate 46.

At product architecture level, it may be noted that the fact that the dome 4 is only in contact with the base plate 46 (prior to assembly on circuit) or on the mounting plate 16 of the circuit (after assembly) makes it possible to provide the actuator 2 in the form of a revolution part (uniform all around its axis of revolution). This simplifies on the one hand its manufacture and on the other hand the mode of assembly. Indeed, no angular orientation of the actuator has to be provided during transfer of the base plate on the assembly line, nor during its assembly onto the other parts of the switch.

The switch in accordance with the invention is additionally remarkable in that it can be assembled on any type of electric circuit mounting plate, such as a printed circuit board, a connection panel, etc and can perform a switching operation by direct contact on conductive tracks. Furthermore, several such switches can be assembled on one and the same mounting plate, depending on the applications envisaged. It is therefore not necessary to provide a mounting plate dedicated to a single switch, which is the case with conventional micro-switches.

It can be understood from what has been said above that the switch 1 in accordance with the present invention is unitary even before it is assembled, and lends itself to standardisation in accordance with a great number of different applications.

Furthermore, it:

- offers effective protection of the switch zone 6 against external pollution;
- allows switching to be performed directly by contact on the conductive tracks 8, 10 of the printed circuit 16;
- may be assembled on different circuit types simply by being clipped on without requiring subsequent welding: and
- requires few parts in order to fulfil the functions.

The invention allows a great number of alternatives, both in terms of the shape of the parts, their arrangement, anchoring means, relative dimensions, materials and processes used in the manufacture and of the circuit supports.

Furthermore, the invention finds application in a very great number of fields of industrial activity that use blister switches.

The invention claimed is:

1. Switching device intended for assembly on an electric printed circuit mounting plate comprising contacts to be electrically connected when a switching operation is performed, the device including a switch component associated with an actuator, allowing the electrical connection to be established between said contacts when the switch component is deflected under pressure transmitted by the actuator, the device being characterised in that the device additionally includes a base plate equipped with holding means for holding the switch component prior to the assembly of the device on the mounting plate, the switch component being disengaged from these holding means when the device is assembled on the mounting plate.

2. Device according to claim 1, characterised in that the switch component is supported only by the mounting plate when the device is assembled on the mounting plate, the base plate then providing only a guidance function for the switch component.

3. Device according to claim 1, characterised in that the switch component disengages itself naturally from the holding means under the effect of a push exerted on said switch component by the mounting plate when the device is assembled on the mounting plate.

4. Device according to claim 1, characterised in that the switch component is assembled floating relative to the base plate between an initial position in which the switch component is stopped against the holding means and a second position in which the switch component is disengaged from the holding means, the second position being adopted automatically through the installation of the device on the mounting plate.

5. Device according to claim 1, characterised in that the switch component includes at least one appendage the free end of which forms a hook, the holding means having a stop for the hook that prevents the switch component from being withdrawn via the surface of the base plate (16) turned towards the mounting plate.

6. Device according to claim 5, characterised in that the at least one appendage is a resilient segment starting from one corner of the switch component (4) and the end of which is supported against an internal bearing surface of the base plate, allowing the switch component to be guided relative to the base plate.

7. Device according to claim 1, characterised in that the base plate forms a frame around the switch component, and in that a peripheral wall of the frame has a contact edge intended to be supported against the mounting plate when the device is assembled on it.

8. Device according to claim 7, characterised in that the contact edge constitutes a seal protecting an internal part.

9. Device according to claim 7, characterised in that the peripheral wall has an edge, opposite the contact edge (46*c*), intended to receive a base portion of the actuator.

10. Device according to 1, characterised in that the actuator is a revolution part.

11. Device according to claim 1, characterised in that device additionally includes a connection part intended to hold the actuator on the base plate and to ensure the assembly of the device on the mounting plate.

12. Device according to claim 11, characterised in that the connection part anchors the device to the mounting plate via gripping means that anchor the device to the mounting plate without welding.

13. Device according to claim 12, characterised in that the gripping means form snap-on means intended to pass through at least one hole in the mounting plate and to be anchored against a surface opposite that on which the device is assembled.

14. Device according to claim 11, characterised in that the connection part holds a base portion of the actuator in a sandwich against the base plate.

15. Device according to claim 11, characterised in that the connection part includes at least one pin an end of which forms a means for anchoring to the mounting plate, and one part of which incorporates fastening means intended to engage with fastening means connected to the base plate.

16. Device according to claim 1, characterised in that the base plate is made in a single piece of flexible plastic material or elastomer.

17. Device according to claim 1, characterised in that said switch component is presented in a form of a dome.

18. Device according to claim 17, characterised in that the dome is a blister dome.

19. Device according to claim 17, characterised in that the switch component is metal.

20. Device according to claim 17, characterised in that the switch component is metallized.

21. Process for manufacturing a switching device, characterised in that at least one part among the group including: a connection component, a switch component, and a base plate, is manufactured on a bearing strip, and in that the at least one part is connected to the bearing strip during assembly of the switching device, said bearing strip being also used as a means for packaging the at least one part between manufacture of the at least one part and assembly of the device.

22. Process according to claim 21, characterised in that each of the parts of said group is made on a respective bearing strip.

23. Process according to claim 21, characterised in that the bearing strip is additionally used for packaging the device once the device is assembled.

24. Process according to claim 23, characterised in that the bearing strip is used for assembling the device on a mounting plate, wherein the bearing strip is of a strip feed type.

25. Process according to claim 21, implementing a connection part including at least one pin, an end of which forms a means for anchoring to the mounting plate, and one part of which incorporates fastening means intended to engage with fastening means connected to the base plate, characterised in that the process includes the steps of: orientating pins flared relative to a central axis of the connection part, the flare being in a direction of separation from the central axis towards a free end, joining the connection part to the base plate.

* * * * *